US006418868B1

(12) United States Patent
Rhodes

(10) Patent No.: US 6,418,868 B1
(45) Date of Patent: Jul. 16, 2002

(54) AUTOMATIC BUTTON FEEDING AND SEWING DEVICE

(75) Inventor: Jeff Rhodes, Muscatine, IA (US)

(73) Assignee: McKee Button Company, Muscatine, IA (US)

( * ) Notice: Subject to any disclaimer, the term of this patent is extended or adjusted under 35 U.S.C. 154(b) by 0 days.

(21) Appl. No.: 09/663,581

(22) Filed: Sep. 18, 2000

(51) Int. Cl.[7] ..... D05B 19/16; D05B 3/22

(52) U.S. Cl. ..... 112/475.15; 112/110; 112/113; 112/470.01

(58) Field of Search ..... 112/475.15, 470.01, 112/470.05, 470.06, 470.14, 110, 111, 112, 113

(56) References Cited

U.S. PATENT DOCUMENTS

| | | | | |
|---|---|---|---|---|
| 4,594,953 A | | 6/1986 | Ando et al. | |
| 4,884,517 A | | 12/1989 | Asao et al. | |
| 5,062,373 A | | 11/1991 | Kichizo et al. | |
| 5,088,428 A | * | 2/1992 | Frye | 112/112 X |
| 5,092,256 A | * | 3/1992 | Kojima | 112/112 |
| 5,878,403 A | | 3/1999 | Defrancesco et al. | |
| 6,234,096 B1 | * | 5/2001 | Suh | 112/113 |

OTHER PUBLICATIONS

McKee Button Company—Buttonmatic Hi–Speed Button Feeder Installation, Operation, and Maintenance Manual.

* cited by examiner

*Primary Examiner*—Peter Nerbun
(74) *Attorney, Agent, or Firm*—Douglas J. Stilwell

(57) ABSTRACT

The present invention comprises a method and an apparatus for rapidly orienting and advancing buttons to be sewn. The invention employs a Programmable Logic Controller to control the steps of orientation and advancement and eliminates the need for time consuming set-up and adjustment of limit switches to control the movement of components within the button oriented and advancer. The use of a Controller to actuate the steps of orientation and advancement allows for the reduction of parts and consolidation of parts onto one plate that may be easily affixed to an industrial sewing head.

17 Claims, 7 Drawing Sheets

AUTOMATIC BUTTON FEEDING AND SEWING DEVICE

BACKGROUND OF THE INVENTION

The present invention relates to machines for sewing buttons and specifically machines for the loading, advancing, aligning, sewing, and ejecting of buttons at a rapid pace. The prior art includes add-on units for use in combination with industrial sewing heads to accomplish these objects. These prior art devices have traditionally demanded multi-step, labor intensive installation including many adjustments to ensure proper placement of interrelated mechanical parts. Such prior art machines have used swing arms, rotary discs, or other elements to move buttons into position under a sewing needle and to subsequently displace the original button and advance a new button into position. U.S. Pat. Nos. 4,594,953, 4,884,517, and 5,062,373 all demonstrate prior art button loading or sewing devices.

The prior art also includes Mckee Button's own "Buttonmatic 1097" which employs a button feeding track to carry buttons from a vibrating dish type dispenser to a button chute located on a clamp assembly positioned generally below and behind the sewing needle. The clamp assembly of the 1097 receives buttons from the track into a button chute. A gear assembly with button hole pins aligns buttons within the chute to receive a needle and thread, and advances buttons to the sewing position. The 1097 also includes two side panel control plates mounted on the upper arm of the industrial sewing head. These side panel control plates use limit switches and precise adjustments to mechanically drive and control the various functions (rotate, advance, tilt, and return) that must be performed upon the button engaging portion of the 1097.

Air cylinders on the side panels drive extension rods that move hinged or sliding push rods to control the gear assembly that lies below on the clamp assembly. These air cylinders operate based upon the mechanical activation of limit switches that have been carefully arranged to contact moving parts, such as the push rods, in the desired sequence. This careful arrangement also determines the stroke length for the motion of parts and, as such, precise placement of limit switches is an important objective of set up and maintenance on the 1097.

SUMMARY OF THE INVENTION

The present invention is a simplified device for use with a sewing machine for the loading, aligning, and advancing of buttons. Control of a button orienting gear assembly is provided directly through a Programmable Logic Controller and electric air valves. The Controller coordinates the delivery of compressed air to various air cylinders. Each air cylinder, in turn, provides force to advance, tilt, or orient the gear assembly. A diagonal spring exerts a return force to bring the gear assembly back to a resting state after an advance and tilt step. By eliminating limit switch control as the primary means for gear assembly orientation, tilt, and advance, numerous parts are eliminated. The invention greatly reduces the time required to set-up an automatic button sewing attachment because it eliminates the need to carefully position a series of limit switches upon mounting plates with setting screws. In the prior art, these limit switches served to police the range of motion for mechanical push bars and to coordinate, in sequence, the steps to advance, tilt, and orient button engaging pins. Because the timed control of cylinder actuation through a Controller replaces the activation of air cylinders through mechanically activated limit switches, the precise adjustments of the prior art no longer need to be performed by the end user. In addition, the preferred embodiment of the present invention includes a compact arrangement of parts on a mounting surface, such as single clamp frame, rather than arrangement on a clamp frame and on separate side plates. This simplified design reduces installation steps, simplifies operation, and eliminates the movement of interrelated mechanical parts from the sides of the sewing heads (where they may more easily be damaged by contact from a user). The present invention may also be practiced with the use of motive means other than extension cylinders to drive the orient, advance and tilt steps.

DETAILED DESCRIPTION OF THE PREFERRED EMBODIMENT

Figure 1:
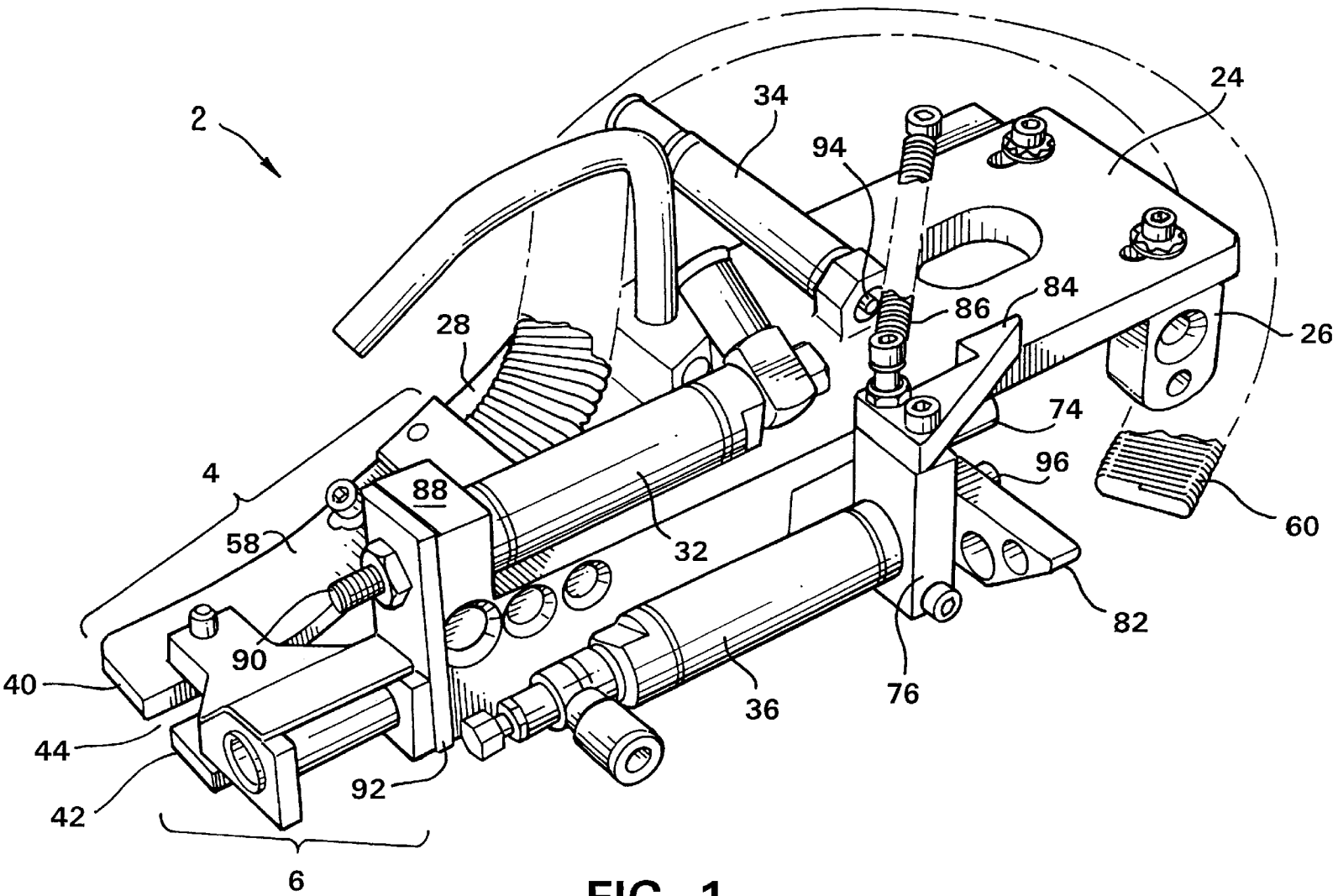
FIG. 1 is a perspective view of the clamp assembly.
Figure 2:
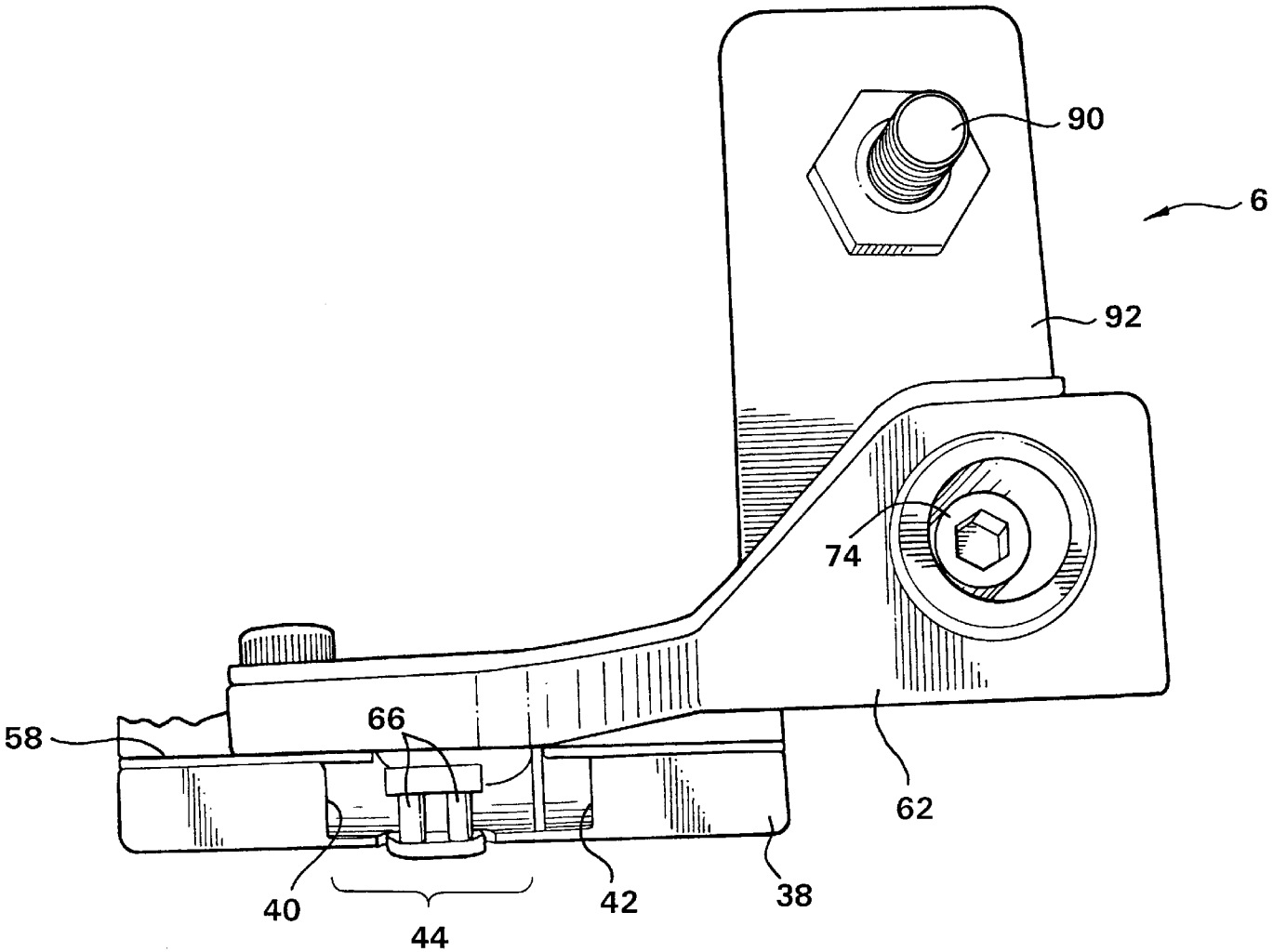
FIG. 2 is a detailed front elevation front view of the gear orienting assembly.
Figure 3:
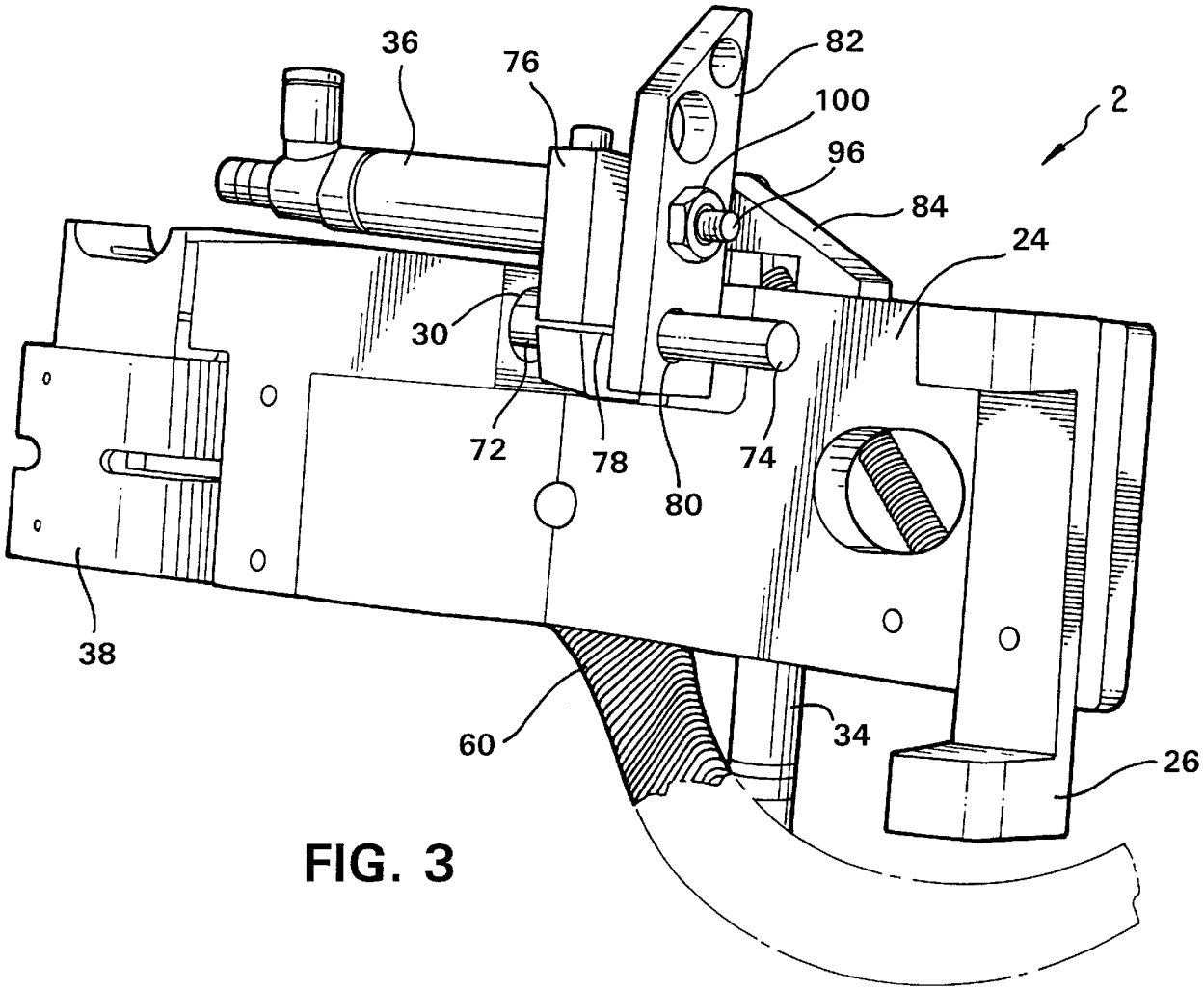
FIG. 3 is a perspective view of the underside of the clamp assembly.
Figure 4:
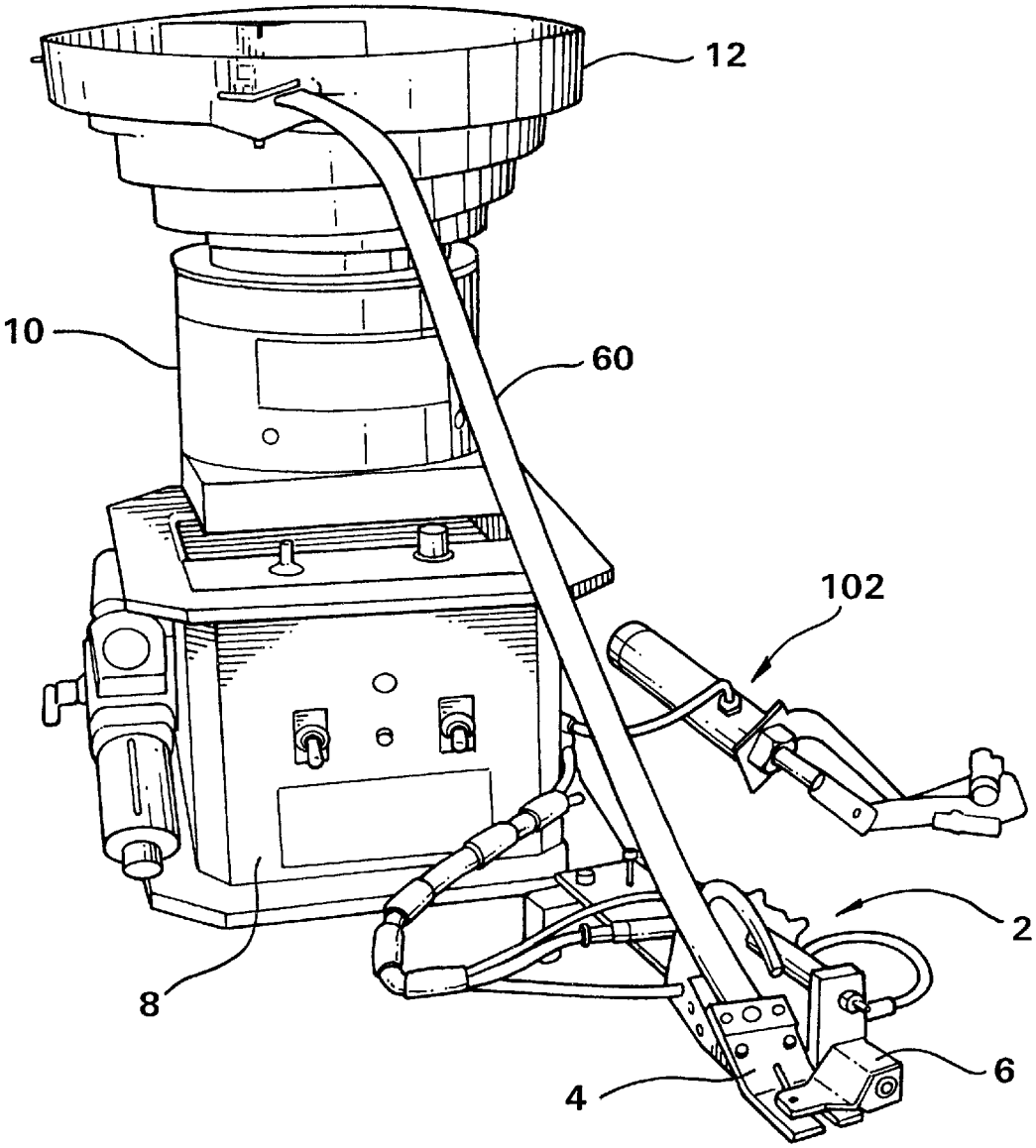
FIG. 4 is a perspective view of the control box, vibrating unit, button track, and assemblies.
Figure 5:
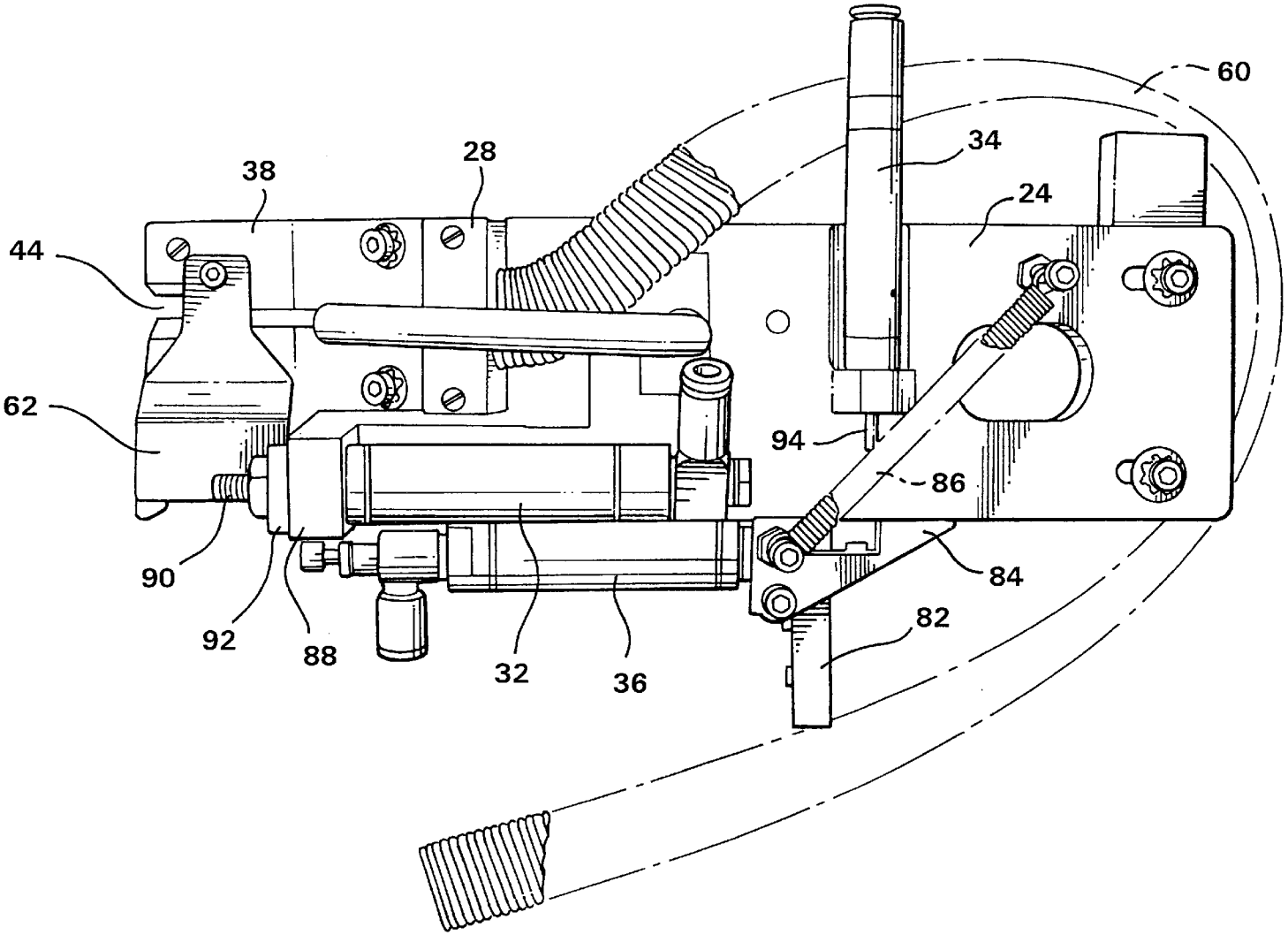
FIG. 5 is a top view of the clamp assembly.
Figure 6:
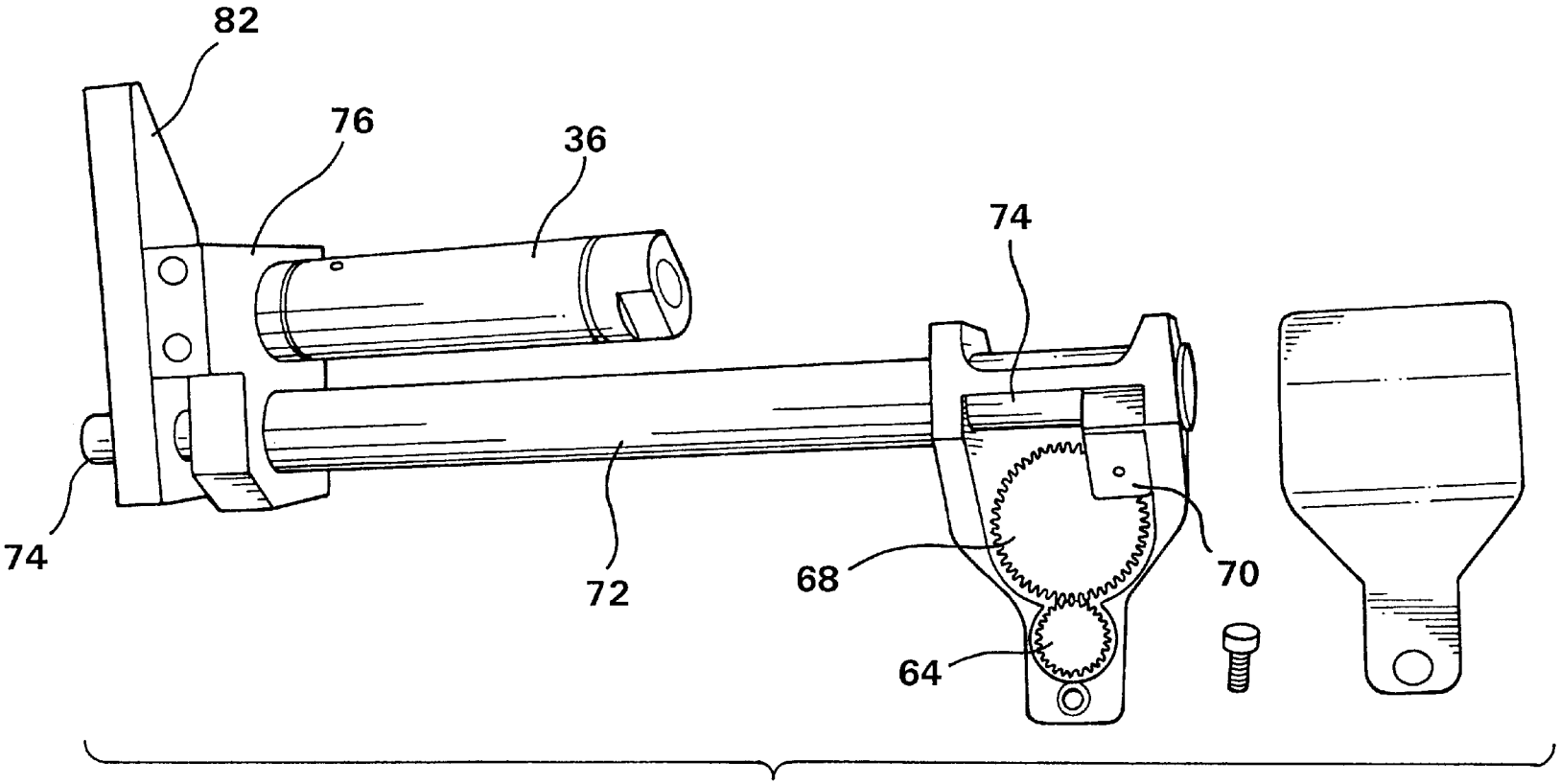
FIG. 6 is a top view of the partially disassembled gear assembly.
Figure 7:
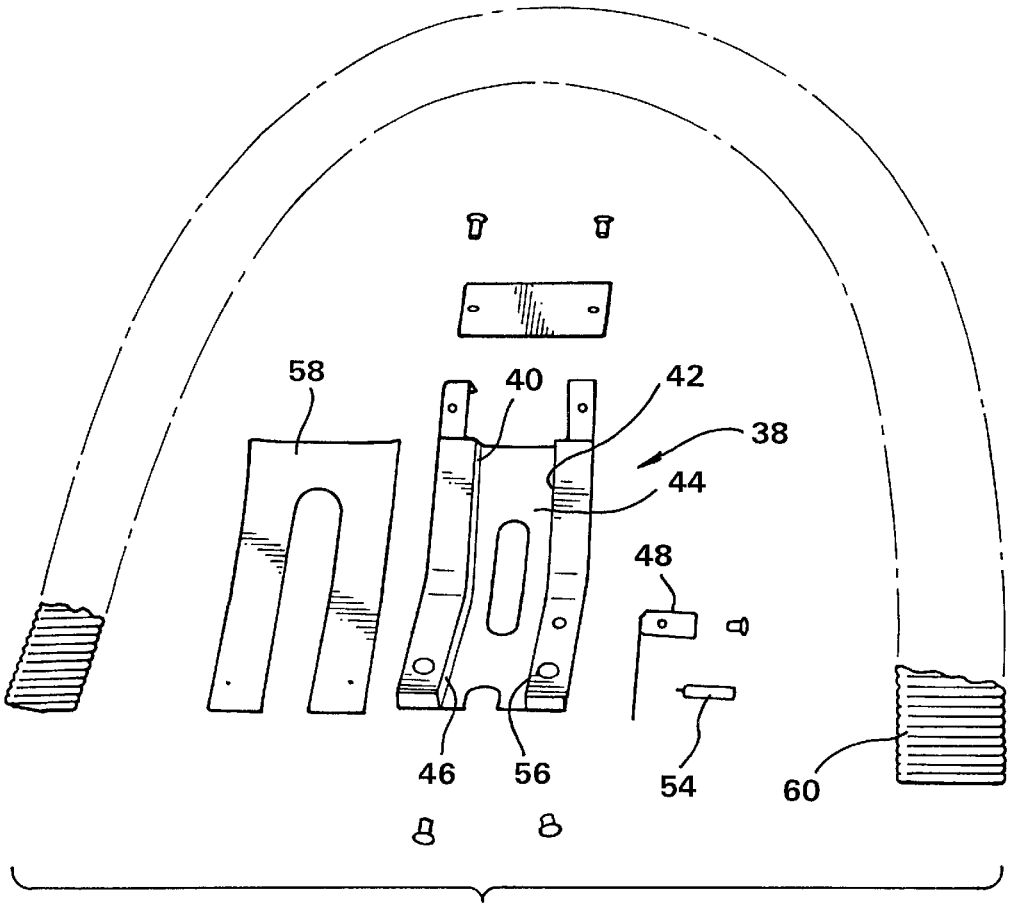
FIG. 7 is a top view of the disassembled button chute.

The present invention relates to a button sewing apparatus that includes a clamp assembly 2, a chute assembly 4, an orient gear assembly 6, a Programmable Logic Controller 8, a vibrator 10, and a button dish 12. Industrial sewing heads 14 that are well known in the art typically comprise a base 16, a rear post 18, and an upper arm 20. The upper arm 20 includes the housing for a sewing needle 22 that is positioned on the upper arm 20 front end, away from the rear post 18. The presently preferred embodiment of the invention is an accessory that may be added to an industrial sewing head. However, the present invention may also be an integral component of a sewing machine rather than a separately manufactured accessory. In the preferred embodiment, the clamp assembly 2 is mounted on the sewing head base 16 under the upper arm 20. The chute assembly 4 and orient gear assembly 6 are mounted on the clamp assembly 2.

The clamp assembly 2 includes a clamp frame 24 that serves as the superstructure on which the other assemblies 4, 6 and the other components of the clamp assembly may be mounted. The clamp frame 24 has a rear end and a front end, and the clamp frame 24 is attached to the sewing head 14 by a clamp pivot 26 located on the clamp frame 24 rear end. The clamp frame 24 front end includes a sloped chute assembly mounting face 28 and a drive shaft tunnel 30. Air cylinders, 32–34, mounted on the clamp frame 24, include air cylinder housings and longitudinally extendable rods. The air cylinders include an advance air cylinder 32 mounted generally above and parallel with the drive shaft tunnel 30 a tilt air cylinder 34 mounted generally behind the sloped chute assembly mounting face 28 and in a generally perpendicular arrangement with the drive shaft tunnel 30, and an orient air cylinder 36 mounted generally beside and parallel with the drive shaft tunnel 30. Although the scope of the present invention is not limited to the presently described arrangement of cylinders, this arrangement is preferred due to the reduction in parts that may be achieved and the compact design. Cylinder arrangement on the clamp assembly 2 is made possible by the elimination of limit switches which occupied space and necessitated side plate controls in the prior art.

The chute assembly includes a chute 38 mounted on the clamp frame's sloped chute assembly mounting face 28. The chute 38 includes first and second chute side walls 40, 42 that form a button path 44 therebetween. The upper, rear portion of the button path 44 defines a point of entry for buttons fed into the chute 38 from a flexible track 60. Lower on the sloped button path is a button sewing position. At the button sewing position, the first chute side wall 40 includes a button sewing depression 46. Attached to the second button chute side wall generally across the button path 44 from the sewing depression 46 is a chute spring 48 that includes a chute spring anchor 50 and a chute spring wire 52. The chute spring anchor 50 is mounted on the second chute sidewall 42 and the chute spring wire 52 is attached to a spring plunger 54 located in a spring plunger recess 56 in the second chute side wall. The chute spring wire 52 is flexed or bowed to present a spring force directed across the button path and towards the sewing position depression 46. This spring force, asserted against a button in the sewing position, aids to secure the button so that the button may be sewn. The chute cover 58 covers the button path 44. A flexible button track 60 extends from the rear of the chute 38 and button path 44 to a button source.

The front portion of the orient gear assembly 6 is positioned over the chute assembly 4. The orient gear assembly 6 includes a gear housing 62 that contains an orienting gear 64 with downwardly extending pins 66, a pinion gear 68, and a gear actuator 70. The gear housing 62 is attached to the front end of a drive shaft housing 72 that extends rearwardly therefrom and through the drive shaft tunnel 30 of the clamp assembly 2. A generally cylindrical drive shaft 74 is located within the drive shaft housing 72 and extends into the gear housing 62. The drive shaft 74 is sliceable within the drive shaft housing 72, and the drive shaft housing 72 is rotatable about its longitudinal axis. The gear actuator 70 is mounted on the drive shaft 74 and may engage the pinion gear 68 to rotate the pinion gear 68 which, in turn, rotates the orient gear 64.

The drive shaft 74 and drive shaft housing 72 extend rearwardly from the gear housing 62 through the drive shaft tunnel 30. The drive shaft 74 extends outwardly from a rear exit of the drive shaft tunnel 30 and through a first opening 78 in the orient cylinder mount 76 and a first opening 80 in an orient arm 82. A tilt arm 84 is attached to the top of the orient cylinder mount 76. A housing return spring 86 extends from the tilt arm 84 to a location on the top of the clamp frame 24 behind the tilt arm 84.

An advance air cylinder 32 is mounted on the clamp frame 24 by an advance mount 88. Preferably, the advance air cylinder 32 is mounted generally parallel with the drive shaft 74 and drive shaft housing 72. An advance extension rod 90 that is longitudinally extendable from the forward end of the advance air cylinder 32 is attached to a size plate 92 that extends downward from the advance extension rod 90 and engages the gear housing 62.

A tilt air cylinder 34 is mounted on the clamp frame 24 preferably with the tilt air cylinder longitudinal axis located generally perpendicular to the drive shaft 74 and drive shaft housing 72. The tilt extension rod 94 is longitudinally extendable from within the tilt air cylinder 34. When extended, the tilt extension rod 94 communicates force to the tilt arm 84.

An orient extension rod 96 extends longitudinally from the orient cylinder 36 positioned generally parallel with the drive shaft housing 72. The orient extension rod 96 extends rearwardly through an orient mount 76 second opening 98 and an orient arm 82 second opening 100. The orient extension rod 96 is secured to the rear side of the orient arm 82.

In operation, the Controller 8 opens air valves to supply compressed air to the air cylinders in an appropriately timed order to effect the following sequence (from an assumed starting position wherein the orient pins 66 engage a properly aligned button that lies in the loading position in the button path 44 of the chute 38). When provided with a supply of compressed air, the advance air cylinder 32 forces the advance extension rod 90 forward, which causes the size plate 92, and the rest of the gear housing 62, to move forward along the drive shaft 74 and against the resistance of the housing return spring 86. This advance step moves a button from the loading position in the button path 44 of the chute assembly 2 to the sewing position.

Next, the Controller 8 opens the appropriate valve to supply compressed air to the tilt air cylinder 34. Actuation of the tilt air cylinder 34 causes the tilt extension rod 94 to extend and strike the tilt arm 84. The application of force upon the tilt arm 84 by the tilt extension rod 94 causes the tilt arm 84, orient cylinder mount 76, orient arm 82, orient cylinder 36, and drive shaft housing 72 to rotate. This rotation of the drive shaft housing 36 forces the gear housing 62 to tilt away from the sewing position. This upward tilt disengages the orient pins 66 from the advanced button.

When the orient pins 66 are disengaged from the button, and the gear housing 62 is in a tilted position, and when the Controller 8 no longer supports the advancement of the advance air cylinder 32, the diagonal spring 82 may draw the tilt arm 84, orient cylinder mount 76, and orient arm 82 back to their resting positions, and the gear housing 62 and drive shaft housing 72 to their rear positions. While the diagonal spring draws the drive shaft 74 rearward, the PLC Controller 8 supplies compressed air to the orient air cylinder 36. This actuates the orient air cylinder 36 and causes the orient extension rod 96 to force the orient arm 82 and drive shaft 74 rearward. This rearward motion of the drive shaft draws the drive shaft 74 rearward within the drive shaft housing 72 and gear housing 62. As a result, the gear actuator 70 is pulled against and rotates the pinion gear 68 which, in turn, rotates the orient gear 64. The rotating pins 66 attached to the orienting gear 64 fall into the button waiting in the button loading position when the gear housing 62 and rotating orient pins 66 return from the tilted and advanced position. When the orient pins 66 engage the button, continued rotation causes the button to become properly oriented for receipt of a needle and thread.

Preferably arranged in a separate or stand-alone unit apart from the industrial sewing head is the Controller 8 and air valves. Using a convenient power source and working fluid, preferably a 115 volt electric source and compressed air at 45 PSI, the controller 8 opens and closes the above referenced air valves to communicate compressed air through conduits, such as hoses, to the cylinders 32, 34, 36. As previously described, the air cylinders in turn control the advance, tilt, orient, and return of the orient gear assembly 6. The Controller 8 also controls power to a start unit that is affixed to the sewing head and which allows a user to start the sewing machine, and the button sewing sequence, with a foot pedal. Finally, a vibrating unit 10 and button dish 12, may be used in combination with the Controller 8, clamp assembly 2, and orient gear assembly 6 to feed buttons through the flexible track 60 to the chute assembly 4.

When the gear housing 62 is tilted away from the button path 44, the time required for the orient gear assembly 6 to return, drop, and engage and orient the next button is sufficient to allow the sewing head to attach the positioned button to the article being sewn before the next button is advanced to the sewing position. A thread wiper, as commonly known in the art may be used, preferably anchored to the sewing head upper arm, to clear thread following the sewing the positioned button.

Having thus described the invention in connection with the preferred embodiments thereof, it will be evident to those skilled in the art that various revisions can be made to the preferred embodiments described herein without departing from the spirit and scope of the invention. For example, working fluid other than compressed air may be employed with appropriate valves; electronic or other power means may be used to provide a motive means as required to orient, advance, and tilt; and configuration of parts and assemblies may differ from the preferred embodiment and the illustrations herein. It is my intention, however, that all such arrangements, revisions and modifications that are evident to those skilled in the art will be included within the scope of the following claims.

I claim:

1. A method for rapidly orienting, positioning, and sewing a button comprising the steps of:

(a) providing the button at a loading position;

(b) utilizing a programmable logic controller to:

(i) orient the button for sewing, (III) advance the button to a sewing position, and (III) actuate a sewing head to sew the button; wherein:

the programmable logic controller orients the button for sewing by rotating pins which release ably engage the button.

2. A method for rapidly orienting, positioning, and sewing a button comprising the steps of:

(a) providing the button at a loading position;

(b) utilizing a programmable logic controller to:

(i) orient the button for sewing, (III) advance the button to a sewing position, and (III) actuate a sewing head to sew the button; wherein:

the programmable logic controller orients the button for sewing by opening a valve to supply a working fluid to an extension cylinder which provides a motive force to induce rotation of an orient gear having button-engaging pins extending therefrom, which pins release ably engage the button.

3. The method of claim 2 wherein the working fluid is compressed air.

4. A method for rapidly orienting, positioning, and sewing a button comprising the steps of:

(a) providing the button at a loading position;

(b) utilizing a programmable logic controller to:

(i) orient the button for sewing, (III) advance the button to a sewing position, and (III) actuate a sewing head to sew the button;

(c) providing a generally continuous stream of buttons at the loading position such that a subsequent button generally becomes available at the loading position when a preceding button is advanced.

5. The method of claim 4 wherein the generally continuous stream of buttons is supplied through a track.

6. The method of claim 5 wherein the track receives the generally continuous stream of buttons from a vibratory dish source.

7. A button positioning apparatus for positioning a button to receive a needle, said apparatus comprising:

a mounting surface;

an oriented attached to the mounting surface, said oriented being adapted to the button having a surface with holes therein to align said holes to receive a needle and a thread, said oriented being movable to engage and disengage said button;

an advancer for moving the button from a loading position to a sewing position; and a specifically programmed programmable logic controller communicatively combined with the oriented and advancer;

a button conveyor combined with the mounting surface to provide a button at a loading position wherein:

the button conveyor comprises a flexible track having a first end and a second end, said track first end being attached to the mounting surface and said track second end being attached to a vibratory button dispenser.

8. A button positioning apparatus for positioning a button to receive a needle, said apparatus comprising:

a mounting surface;

an oriented attached to the mounting surface, said oriented being adapted to the button having a surface with holes therein to align said holes to receive a needle and a thread, said oriented being movable to engage and disengage said button;

an advancer for moving the button from a loading position to a sewing position; and a specifically programmed programmable logic controller communicatively combined with the oriented and advancer; wherein the oriented comprises:

rotatable button engaging pins that may engage holes in a button and cause the button to rotate.

9. The button positioning apparatus of claim 8 wherein:

the oriented further comprises a gear having the button engaging pins extending therefrom.

10. The button positioning apparatus of claim 9 further comprising:

a motive means combined with the mounting surface for producing a linear motive force, and a pinion combined with the motive means and the gear, said pinion being adapted to translate the linear motive force to rotate the gear means.

11. The button positioning apparatus of claim 10 wherein:

the motive means comprises an air cylinder having an extension rod that is extendible therefrom.

12. A button positioning apparatus for positioning a button to receive a needle, said apparatus comprising:

a mounting surface;

an oriented attached to the mounting surface, said oriented being adapted to the button having a surface with holes therein to align said holes to receive a needle and a thread, said oriented being movable to engage and disengage said button;

an advancer for moving the button from a loading position to a sewing position; and a specifically programmed programmable logic controller communicatively combined with the oriented and advancer; wherein:

the advancer comprises a drive shaft housing combined with the mounting surface, said housing having a longitudinal opening therein;

a drive shaft being extendible from and movable within the longitudinal opening in the drive shaft housing;

an advancing means for producing a linear motive force, said advancing means being in communication with the drive shaft.

13. The button sewing apparatus of claim 12 wherein:

the advancing means comprises an extension cylinder.

14. A button positioning apparatus for positioning a button to receive a needle, said apparatus comprising:

a mounting surface;

an oriented attached to the mounting surface, said oriented being adapted to the button having a surface with holes therein to align said holes to receive a needle and a thread, said oriented being movable to engage and disengage said button;

an advancer for moving the button from a loading position to a sewing position; and a specifically programmed programmable logic controller communicatively combined with the oriented and advancer; wherein the oriented and advancer comprise button engaging pins that extend from a gear housing; and wherein the gear housing is attached to a drive shaft, said drive shaft and gear housing being sliceable to move a button between a loading position and a sewing position, and said drive shaft and gear housing being rotatable about a longitudinal axis of the drive shaft; said apparatus further comprising a disengage in communication with the oriented and advancer, said disengage being adapted to rotate the drive shaft and gear housing to about the longitudinal axis of the drive shaft to cause the pins to disengage the button.

15. The button positioning apparatus of claim 14 wherein:

the disengage comprises an extension means movable between a retracted and an extended position, said extension means being adapted to force the drive shaft to rotate when the extension means moves between the retracted and extended position.

16. The button positioning apparatus of claim 15 further comprising:

a tilt arm rigidly combined with the drive shaft; and a spring means having a first end and a second end, said first end being combined with the mounting surface, and said second end being combined with tilt arm, said spring means being adapted to exert a tensile force against the tilt arm that causes the drive shaft and gear housing to rotate and into engagement with a button and to slide from the button sewing position to the button loading position.

17. A button sewing apparatus for positioning a button to receive a needle, said apparatus comprising:

a clamp frame having a first end and a second end, said clamp frame first end having a button chute thereon for receiving buttons and directing buttons towards a sewing position; said button chute having a first button chute side wall and a second button chute side wall, said side walls forming a button path therebetween, and said button path running generally between a button loading position and the button sewing position;

a rotatable orient gear having pins extending therefrom, said orient gear being mounted within a sliceable and tillable gear housing and said orient gear being positioned so that the pins may enter and withdraw from the button path;

said orient gear being communicatively combined with a movable drive shaft to rotate in response to the motion of the drive shaft;

a movable drive shaft housing having an opening therein through which the drive shaft extends, said drive shaft housing being attached to the gear housing, said housings being sliceable between a first drive shaft position and a second drive shaft position and said housings being movable between a button engagement position and a button disengagement position;

a tilt arm being movable between a first position and second position, said tilt arm being combined with the drive shaft housing to rotate the drive shaft housing about the drive shaft housing longitudinal axis as the tilt arm moves between the tilt arm first position and the tilt arm second position;

a tilt air cylinder comprising a tilt air cylinder housing and a coaxial, longitudinally extendible tilt rod, said tilt rod being movable between a retracted and an extended position, said tilt air cylinder being mounted on the clamp frame and being positioned so that the extendible tilt rod may actuate the tilt arm to move the tilt arm between the first and second tilt arm positions;

an advance air cylinder comprising an advance air cylinder housing and a coaxial and longitudinally extendible advance rod, said advance rod being movable between a retracted and an extended position, said advance air cylinder being mounted on the clamp frame and being positioned so that the advance rod may move the gear housing and the drive shaft housing from the housing retracted position to the housing extended position;

an orient air cylinder comprising a housing and a coaxial and longitudinally extendible orient rod, said orient rod being movable between a retracted and an extended position, said orient rod being combined with the clamp frame and being positioned so that the orient rod may move the drive shaft within the drive shaft housing;

a spring means having a relaxed and a tensile state and a first end and a second end, said first end being attached to the clamp frame and said second end being attached to the tilt arm, said spring means being positioned so that when the spring means is in the tensile state it actuates return of the tilt arm to the tilt arm resting position and return of the housings to the retracted positions;

a programmable logic controller communicatively combined with the orient air cylinder, the advance air cylinder and the tilt air cylinder to actuate the cylinders in a selected sequence.

* * * * *